United States Patent [19]

Peters, Jr.

[11] 4,071,185

[45] Jan. 31, 1978

[54] STRUCTURE FOR LOCKING PARTITIONS IN OPEN POSITION

[75] Inventor: Charles Luther Peters, Jr., Norco, Calif.

[73] Assignee: Box Innards, Inc., Anaheim, Calif.

[21] Appl. No.: 700,386

[22] Filed: June 28, 1976

[51] Int. Cl.[2] ..... B65D 5/48

[52] U.S. Cl. ..... 229/28 R; 229/42; 229/29 E; 229/15

[58] Field of Search ..... 229/27, 28 R, 28 BC, 229/29 E, 15, 42

[56] References Cited

U.S. PATENT DOCUMENTS

| | | | |
|---|---|---|---|
| 650,183 | 5/1900 | Lindley | 229/29 E |
| 1,880,074 | 9/1932 | Coyle | 229/29 E |
| 1,894,402 | 1/1933 | Inman | 229/28 R |
| 2,711,038 | 6/1955 | Snider et al. | 229/29 E |
| 3,963,169 | 6/1976 | Gardner | 229/28 R |

*Primary Examiner*—William Price
*Assistant Examiner*—Douglas B. Farrow
*Attorney, Agent, or Firm*—Perry E. Turner

[57] ABSTRACT

A partition is disclosed wherein one strip has a tab formed at the inner end of an elongated slot, such tab having score lines to facilitate inward collapsing thereof when engaged by the inner end of an elongated slot in the other strip. In the strip with the tab, the outline punched therein for the tab has pronounced shoulders spaced apart less than the width of the tab proper, so that the body of the tab locks against such shoulders when the tab is collapsed. Thus collapsed, the body of the tab extends along the surface of the other strip and prevents relative rotation of the strips towards collapsed condition.

3 Claims, 7 Drawing Figures

STRUCTURE FOR LOCKING PARTITIONS IN OPEN POSITION

BACKGROUND OF THE INVENTION

1. Field of the Invention

This invention relates to partitions as separators for articles packed in boxes and the like.

2. Description of the Prior Art

A problem of long standing in the packing of products in containers has been the delays and jammings of packing procedures and equipment due to collapse of the separators or partitions before the products are inserted in the containers. This is a most vexing problem with so-called "butterfly" partitions, which are composed of a single strip intersected by one or more other strips. In such partitions, the presence of only one strip extending in one direction prevents the type of stability in open partitions of the type having two or more strips extending in both directions. In this regard, partitions made up of one or more strips intersecting with a single strip may be suitably locked to prevent their separation. However, such locking means heretofore known do not secure the partition in open condition when it is inserted in a box.

For example, a four-cell partition is made up of two strips interlocked either by edge or center locking means. The partitions are collapsed for shipment to the packer, where the employees open and insert the partitions in upright position in the containers or boxes in which products are to be shipped. Unfortunately, when such containers arrive at a station at which the products are to be inserted, partitions in a number of the containers have falled over and collapsed, even though they are locked together to prevent being separated. In such cases, the result often is that the packing equipment jams and operations must be halted while the containers in question are removed and the equipment restarted to permit operations to resume. Where containers have gotten through with products inserted onto collapsed partitions, such products vibrate against each other during shipment and become damaged. All such results are undesirably expensive in terms of time, labor, material and customer relations.

SUMMARY OF THE INVENTION

This invention embraces a partition with a locking construction which locks strips together and also holds them in open condition wherein, at each location at which the strips are interlocked, a tab struck in the body of one strip is collapsed by the other strip when the strips are intersected, and such tab extends along the surface of the other strip. Also embraced is a locking tab structure wherein the outline includes shoulders adjacent its fixed end past which the body of the tab must be forced, and which serve to lock the body of the tab in position against the surface of the other strip.

DESCRIPTION OF PREFERRED EMBODIMENT

Figure 1:
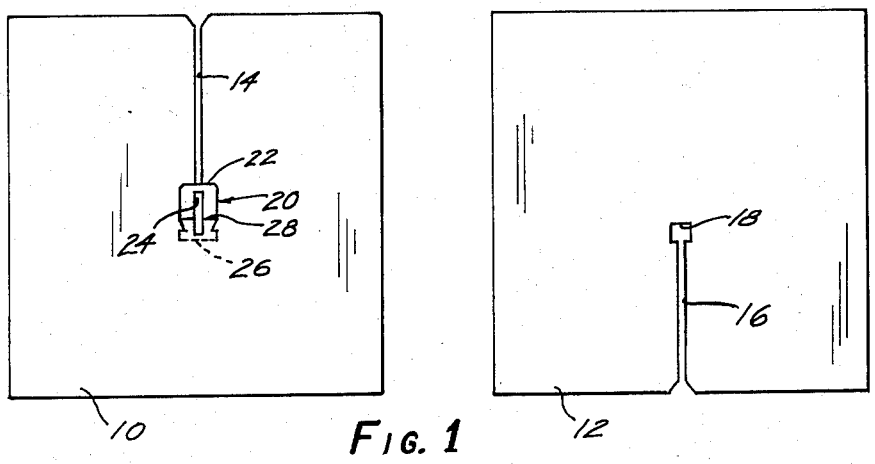
FIG. 1 is a view in elevation of the strips with which to form a partition, showing the slots in the strips and the tab struck in the body of one strip at the inner end of its slot.

Referring to FIG. 1, a pair of strips 10, 12 is shown for forming a four-cell partition. It will be understood that the invention is applicable to any multi-cell partition in excess of four cells, because the slot and tab formations to be described are the same for each intersection of such multi-cell partitions as for the four-cell partition shown and described herein.

The strips 10, 12 are slotted to facilitate their being intersected for the usual purpose. Thus, the strip 10 has a narrow slit or slot 14, the confronting edges of the slot being flared adjacent the outer end of the slot, i.e., the upper edge of the strip 10 in FIG. 1. The strip 12 is also slotted at 16, such slot 16 having confronting edges that flare at the outer end thereof, i.e., the lower edge of the strip 12 in FIG. 1.

The inner end of the slot 16 in the strip 12 is enlarged as shown at 18, such enlargement preferably being generally square or rectangular. The body of the strip 12 at the innermost end of the slot 16, i.e., the inner end of the enlargement 18, is adapted to engage and activate a tab 20 that is struck in the body of the strip 10 when the strips are intersected.

Figure 2:
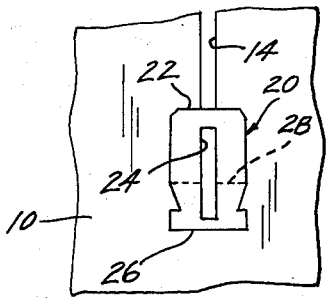
FIG. 2 is an enlarged fragmentary view in elevation of the center portion of the one strip to aid in explaining the tab structure.

As best seen with reference to FIGS. 1 and 2, the tab 20 has an upper end 22 that spans the slot 14. A slot 24 within the body of the tab has its upper end spaced from the upper edge 22 and its lower end spaced from the lower end 26 of the tab. Such lower end of the tab is not struck from the strip, but rather is represented by an indented score line in one surface of the strip. Thus, the lower end of the tab, i.e., the score line, is shown as a solid line 26 in FIG. 2 and as a dotted line 26 in FIG. 1. As will be seen, pressure against the upper end 22 of the tab 20 will cause the lower end of the tab to undergo buckling or bending at its lower end out of the strip 10 and in one direction due to the decreased thickness at the lower end caused by the score line indentation 26.

Figure 3:
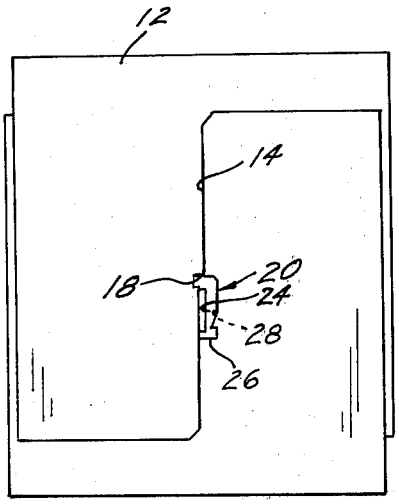
FIG. 3 is an elevation of the strips of FIG. 1 intersected and in collapsed condition.

The remainder of the tab 20 is struck through the body of the strip 10, i.e., all portions of the tab profile above the score line 26. Accordingly, upon intersecting the strips 10, 12 in collapsed condition as shown in FIG. 3, and forcing them together, the pressure exerted against the end 22 of the tab 20 by the inner end 18 of the slot in the strip 12 will cause the tab to collapse about its lower end, i.e., about the score line indentation 26, and bend outside the body of the strip 10. The tab thus is forced to a collapsed position wherein it extends along the surfaces of the other strip 12, i.e., at right angles to the strip 10. The two strips are thus interlocked both against separation and against relative rotation, whereby they cannot collapse after the partition formed thereby is inserted in a container.

Figure 7:
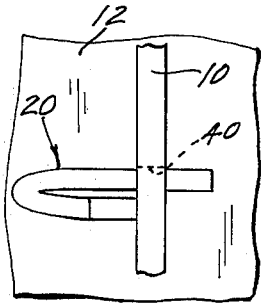
FIG. 7 is an enlarged fragmentary view in elevation taken along the line 7—7 of FIG. 4.

Collapsing of the tab 20 may also be facilitated by scoring it intermediate its ends. In the illustrated arrangement, a score line indentation 28 is made in the surface of the tab opposite the surface in which the lower end score line 26 is formed. Thus, when the pressure is applied to the upper end of the tab 20, it buckles in two directions, viz., the portion above the score line 28 bends about such line and simultaneously the lower portion bends in the opposite direction about the lower score line 26. The bending is as shown in FIGS. 4 and 7.

Additionally, such tab lock construction aids in moving the partition from collapsed to open condition. Referring to FIGS. 3 and 4, the packer receives the partitions in flat or collapsed condition as shown in FIG. 3. The strips are intersected as shown to bring the inner end of each slot 16 of the strip 12 against the upper end of the respective tabs 20 of the strip 10. To open and lock such a partition, it is righted with the lower edge of one strip on a surface, whereupon force applied to the other strip causes relative rotation of the strips to the locked position shown in FIG. 4. The arrow 30 represents the direction of application of force against the upper edge of the strip 12, and the dotted arrow 32 represents the direction of rotation of the strip 10 towards its position at right angles to the strip 12.

Figure 6:
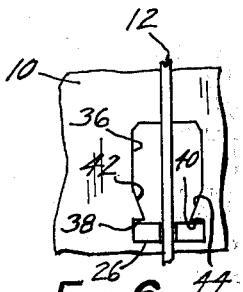
FIG. 6 is an enlarged fragmentary view in elevation taken along the line 6—6 of FIG. 4.

To further aid securing the partition in open condition, provision may be made in accordance with the invention for positive locking of the tab in its collapsed condition. To this end, the tab is formed with a profile such that the opening 36 in the strip 10 corresponding thereto (see FIG. 6) has shoulders 38, 40 spaced from the lower tab edge 26 a distance at least equal to double the thickness of the body of the strip from with the tab is struck. In the illustrated arrangement, the shoulders 38, 40 are the lower portions of transitions which converge from parallel sides, such convergent portions being shown at 42, 44. Thus, the convergent portions of the opening 36 are in interference relation with the body of the tab 20 as it collapses and is forced inwardly. The tab body is thus forced past the convergent portions and below the shoulders, whereupon the tab is securely locked against the shoulders (see FIG. 7).

Figure 5:
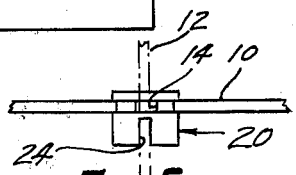
FIG. 5 is a top end view of the middle portion of the partition of FIG. 4.
Figure 4:
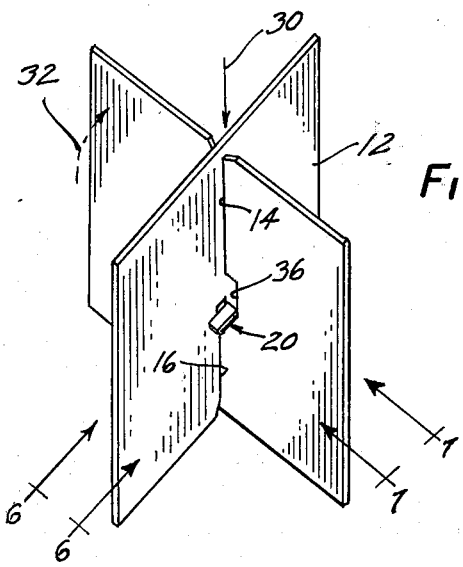
FIG. 4 is a perspective view of the partition with the strips intersected and locked in open condition via the tab.

It should be noted that the slot 24 in the tab 20 is wide enough to slidably receive the strip 12 when the tab is collapsed to locking position as in FIG. 4 and FIG. 5. The strip 12 is shown in phantom in FIG. 5 in order to aid in visualizing the shape of the tab 20 when in locking position.

I claim:

1. A partition comprising:

a pair of vertical partition strips having respective vertical slots, said strips being intersected via said slots, the inner portion of the slot in one strip being enlarged, the sides of said enlarged portion having shoulders adjacent the inner end of said portion;

tab means attached to the inner end of said enlarged slot portion, said tab means prior to interlocking of said strips being coplanar with said one strip and filling said enlarged slot portion, whereby the outer end of said tab means spans the narrow portion of the slot of said one strip, and said outer tab end is engaged by the inner end of the slot in the other strip prior to interlocking of said strips, said tab means being collapsible via force applied to the outer end of said tab means via engagement therewith of the inner end of the slot of said other strip when said strips are at right angles, said tab means when collapsed extending along said other strip to prevent its rotation relative to said one strip, and the body of said tab means when collapsed by said other strip being captured between the inner end of said enlarged slot portion and said shoulders adjacent thereto, whereby said strips are automatically interlocked upon forcing them together when intersected via said slots.

2. A partition as defined in claim 1, wherein said tab means includes an indentation scored on one surface thereof at the end attached to the inner end of said enlarged slot portion, and an indentation scored on the opposite surface thereof intermediate its ends to facilitate collapsing of said tab means upon the strips being forced together as aforesaid.

3. A partition as defined in claim 1, wherein said tab means has an elongated slot intermediate its ends and parallel to its sides to facilitate collapsing thereof.

* * * * *